US008579656B2

(12) United States Patent
Huang

(10) Patent No.: US 8,579,656 B2
(45) Date of Patent: Nov. 12, 2013

(54) POWER SUPPLY WITH DETACHABLE PLUG

(75) Inventor: Chin Chu Huang, Taoyuan County (TW)

(73) Assignee: Delta Electronics, Inc. (TW)

( * ) Notice: Subject to any disclaimer, the term of this patent is extended or adjusted under 35 U.S.C. 154(b) by 34 days.

(21) Appl. No.: 13/468,610

(22) Filed: May 10, 2012

(65) Prior Publication Data

US 2013/0183854 A1 Jul. 18, 2013

(30) Foreign Application Priority Data

Jan. 13, 2012 (TW) ..... 101101479 A

(51) Int. Cl.
*H01R 29/00* (2006.01)

(52) U.S. Cl.
USPC ..... 439/518; 439/171

(58) Field of Classification Search
USPC ..... 439/534, 345, 518, 170, 171, 172, 173, 439/174
See application file for complete search history.

(56) References Cited

U.S. PATENT DOCUMENTS

| | | | | |
|---|---|---|---|---|
| 7,168,968 | B1 * | 1/2007 | Li | 439/172 |
| 7,168,969 | B1 * | 1/2007 | Wang | 439/173 |
| 7,273,384 | B1 * | 9/2007 | So | 439/172 |
| 7,381,059 | B2 * | 6/2008 | Wong | 439/22 |
| 7,946,868 | B1 * | 5/2011 | Chen | 439/173 |
| 8,033,847 | B1 * | 10/2011 | Chen | 439/172 |
| 8,079,877 | B1 * | 12/2011 | Lai et al. | 439/655 |
| 8,226,424 | B1 * | 7/2012 | Wang et al. | 439/172 |
| 8,414,318 | B1 * | 4/2013 | Chen | 439/173 |
| 2011/0117766 | A1 | 5/2011 | Chen | |

OTHER PUBLICATIONS

European Search Report from corresponding application No. 12160362.5-1231, Jul. 23, 2012.

* cited by examiner

*Primary Examiner* — Hae Moon Hyeon
(74) *Attorney, Agent, or Firm* — Lowe Hauptman & Ham, LLP

(57) ABSTRACT

A power supply includes a plug including a base having an accommodating space. Two conductors are provided in the accommodating space. A positioning cover connects a body and further covers the accommodating space. The positioning cover is provided with guiding slots, and a braking ring is arranged between the conductors and the positioning cover. The interior edge of the braking ring is provided with a plurality of positioning grooves, and the plug can rotate on the body. Conductive connecting terminals slide in the guiding slots and are positioned in the positioning groove to be in contact with the conductors.

11 Claims, 11 Drawing Sheets

POWER SUPPLY WITH DETACHABLE PLUG

BACKGROUND

The present disclosure relates to a power supply, especially relates to a power supply which has a detachable multi-directional plug.

Power supply is usually needed to provide the electric power when using an electrical device or used for charging a battery of the electrical device. An ordinary wall-mount type power supply has a fixed type of plug with fixed plug orientation. If the plug orientation is not the same as a wire arrangement direction, a deformation is easily caused at a joint between the wire and a body of the power supply.

SUMMARY

The present invention provides a power supply being able to change the plug type and plugging direction.

The present invention also provides a power supply capable of being used in multiple directions after the plug is assembled.

The present invention also provides a power supply with a detachable multi-direction plug, which fixes the terminal in the plug head, assuring good electric conductivity between the power supply body and the plug.

A power supply of the present invention includes a body having a docking space, and two terminals protruding in the docking space. The plug is connected to the body, and the plug includes a base having an accommodating space, and two conductors are arranged oppositely in the accommodating space. A positioning cover connects the body and covers the accommodating space. The positioning cover is provided with two guiding slots corresponding to two terminals. A braking ring is provided between the two conductors and the positioning cover. The interior edge of the braking ring is provided with a plurality of positioning grooves corresponding to two guiding slots. The plug can do multi-directional rotation on the body. The two terminals slide in the two guiding slots, respectively, and further are positioned in the positioning grooves. The two terminals connect the two conductors correspondingly.

The present invention provides a power supply with a detachable multi-directional plug, which simplifies the structure and volume of the plug, and also decreases the parts of the plug, reaching the goal of easy assembling and disassembling.

The present invention provides a power supply with a detachable multi-directional plug, which uses metallic terminals to contact the positioning grooves of the plastic braking ring, thus reducing the wearing duo to the friction, and further increasing the life of the plug and the multi-direction power supply.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
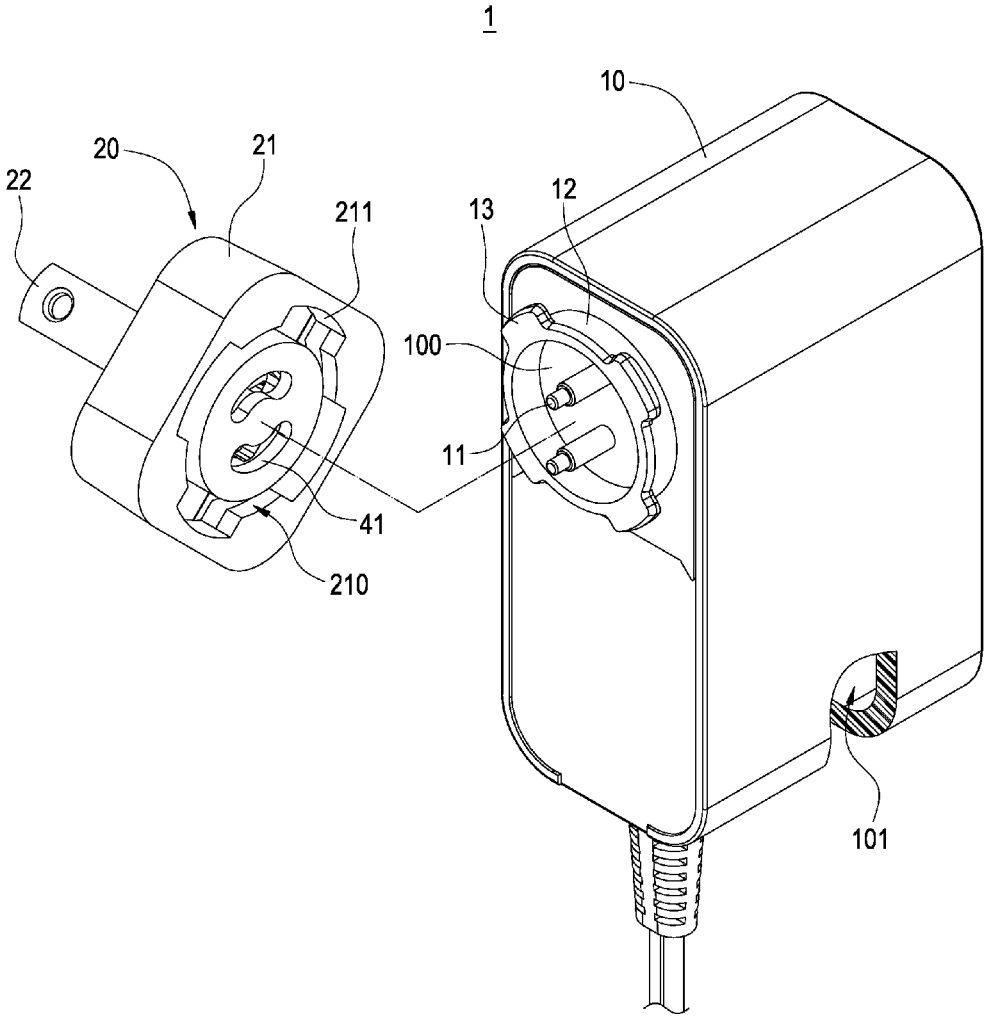
FIG. 1 is a perspective view of a power supply having detachable plug in accordance with one or more embodiments.

Referring to FIG. 1, a perspective view of a power supply having detachable plug in accordance with one or more embodiments is showed. A power supply 1 includes a body 10 and a plug 20 detachablely mounted to the body 10.

The body 10 is formed in a rectangle shape, and the interior 101 of the body 10 is provided with power conversion elements (not shown). One side of the body 10 is provided with a docking space 100 and two terminals 11 protruding from the docking space 100, and the two terminals 11 electrically connect to the interior power conversion elements. In addition, the body 10 is provided with a convex ring 12 on the outer edge of the docking space 100, and a plurality of blocking elements 13 are provided at intervals on the top edge of the convex ring 12.

The plug 20 is detachably connected to the body 10. The plug 20 has a base 21, and the base 21 is provided with an accommodating space 210 and a plurality of embedding slots 211 in the periphery of the accommodating space 210 correspondingly. When the body 10 and the plug 20 are in an assembled state, the blocking elements 13 of the body 10 are correspondingly arranged in the embedding slots 211 and slide in the accommodating space 210.

Figure 2:
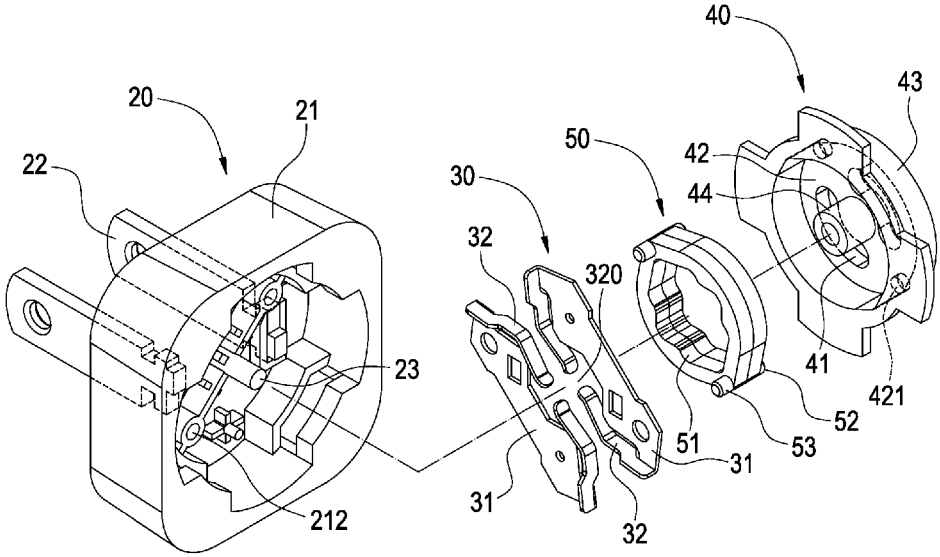
FIG. 2 is an exploded view of a plug of a power supply in accordance with one or more embodiments.

FIG. 2 shows an exploded view of a plug of a power supply in accordance with one or more embodiments. The plug 20 also includes two conductors 30, a positioning cover 40, and a braking ring 50. Two conductors 30 are oppositely arranged in the accommodating space 210. Each conductor 30 includes a retaining board 31 and opposing wings 32 vertically extending to both sides of the retaining board 31. The two opposing wings 32 extend toward each other to define a gap 320.

Preferably, the two conductors 30 are welded and connected to the bottom of the accommodating space 210. The method of connecting the conductor 30 and the accommodating space 210 is not limited to the present embodiment.

The plug 20 further includes two pins 22 which are arranged on one side of the plug 20 and electrically connect to the two conductors 30.

A positioning cover 40 connects the body 10 and covers the accommodating space 210. The positioning cover 40 is provided with two guiding slots 41 corresponding to the two terminals 11. The two terminals 11 are correspondingly arranged in the two guiding slots 41 to further connect the two conductors 30, respectively.

In the present embodiment, the positioning cover 40 includes a cover plate 42 and a side plate 43 surrounding the cover plate 42. Those two guiding slots 41 are arranged on the cover plate 42. The cover plate 42 has a tube 44 between the two guiding slots 41, and the base 21 has a positioning shaft 23 corresponding to the accommodating space 210. The tube 44 is arranged to receive the shaft 23 to fix the positioning cover 40 in the accommodating space 210.

A braking ring 50 is arranged between the two conductors 30 and the positioning cover 40, and the interior edge of the braking ring 50 is corresponding to the two guiding slots 41 and provided with a plurality of positioning grooves 51. The positioning grooves 51 are arranged in the opposite side of the interior of the braking ring 50, and are formed in continuous half arc shape. The braking ring 50 is superposed on the cover plate 42 , and the positioning grooves 51 are overlaid on the two guiding slots 41. In this way, the two terminals 11 will pass through the guiding slots 41 and maintain in the positioning grooves 51. The more detailed connecting method for braking ring 50 is explained below.

The braking ring 50 is fixed between the two conductors 30 and the positioning cover 40. One side of the braking ring 50 has a plurality of first convex pillars 52, and the other side of the braking ring 50 has a plurality of second convex pillars 53. The interior side of the cover plate 42 includes a plurality of first connecting holes 421, and the base 21 of the plug 20 has a plurality of second connecting holes 212 in the accommodating space 210.

When assembling the power supply 1, the first convex pillar 52 is connected to the first connecting hole 421. In some embodiments, the first convex pillar 52 and the first connecting hole 421 are connected by a ultrasonic fusion process or a thermal pressure fusion process. Other combining methods such as screws, adhesives, elastic hooks will be acceptable. When the braking ring 50 is fixed, partially of the braking ring 50 is against the interior wall of the positioning cover 40, and restorable deformation occurs while the braking ring 50 is pressed.

Figure 3:
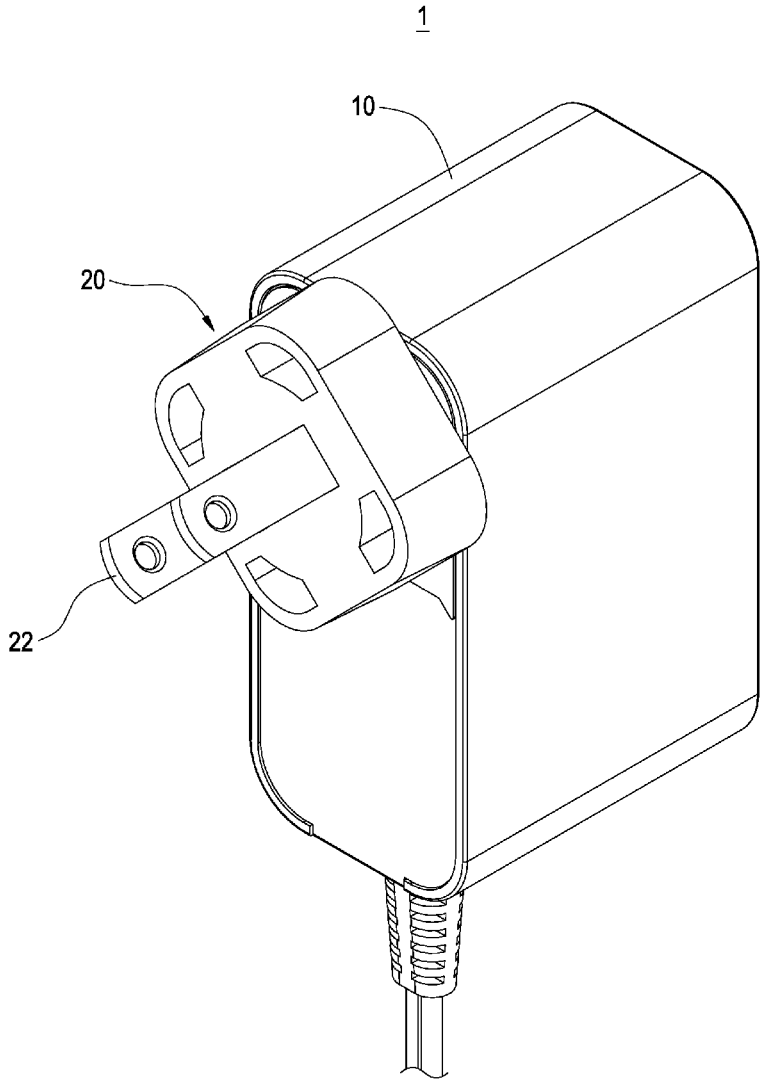
FIG. 3 is a perspective view of a power supply in an assembled state in accordance with the one or more embodiments.
Figure 4:
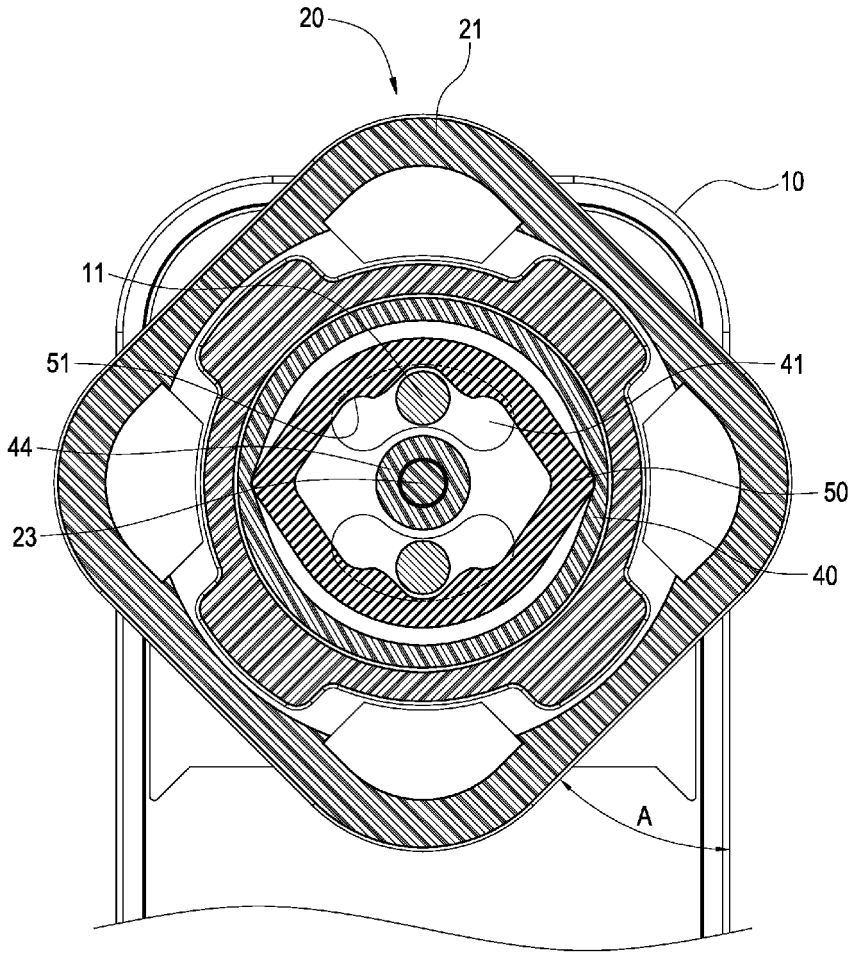
FIG. 4 is a side view of a positioning cover and a braking ring overlaying a side view of a body of a power supply and a contour of a base of a plug in accordance with one or more embodiments.

Referring to FIG. 3, a perspective view of a power supply in an assembled state is showed, and FIG. 4 shows a side view of a positioning cover and a braking ring overlaying a side view of a body of a power supply and a contour of a base of a plug. The plug 20 is not straightly assemble on the body 10 that the plug 20 is aligned with the body 10 by an angle A. The two terminals 11 are approximately in the middle of the two guiding slots 41. As refers to FIG. 5, a side view of two conductors overlaying a side view of a body of a power supply and a contour of a base of a plug is showed. The two terminals 11 are each positioned between a corresponding one of the positioning grooves 51 and the wall of the guiding slots 41, and are not electrically connected to the two conductors 30. The two terminals 11 are situated in a gap 320 which is formed between the two opposing wings 32. At this time, the plug 20 is capable of multi directional rotation (toward left or right) with respect to the body 10. In the present embodiment, the plug 20 can make a 45 degrees right or left rotation with respect to the body 10, depending on demands.

Figure 5:
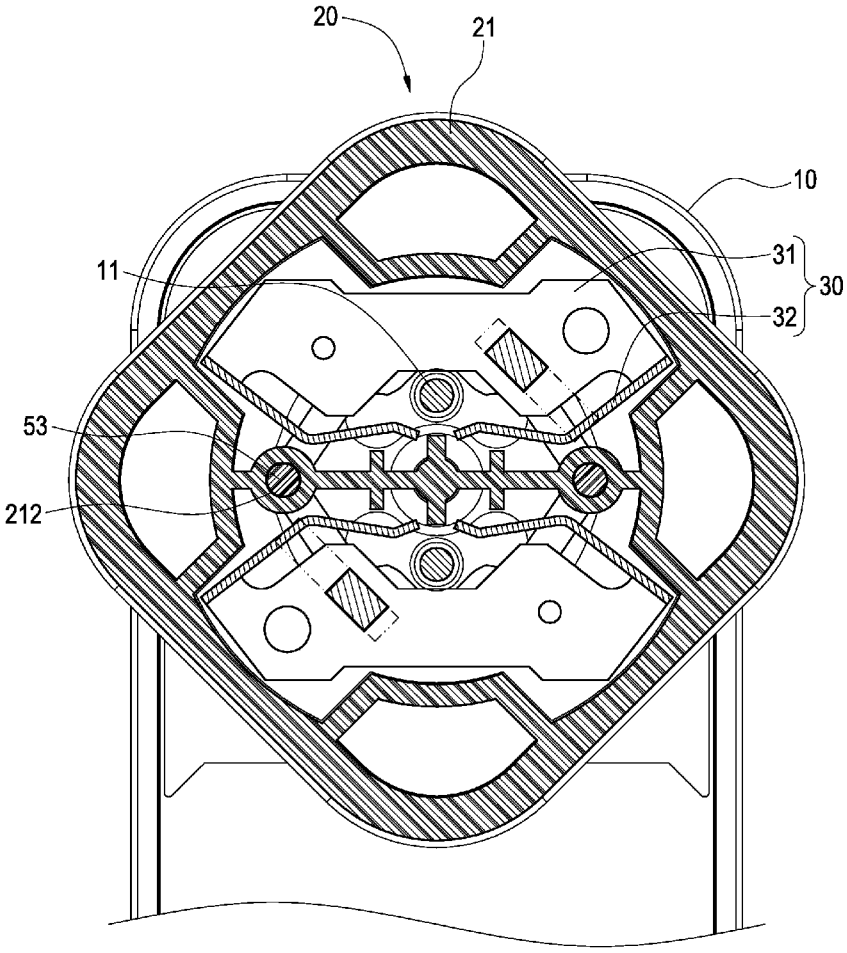
FIG. 5 is a side view of two conductors overlaying a side view of a body of a power supply and a contour of a base of a plug in accordance with one or more embodiments.
Figure 6:
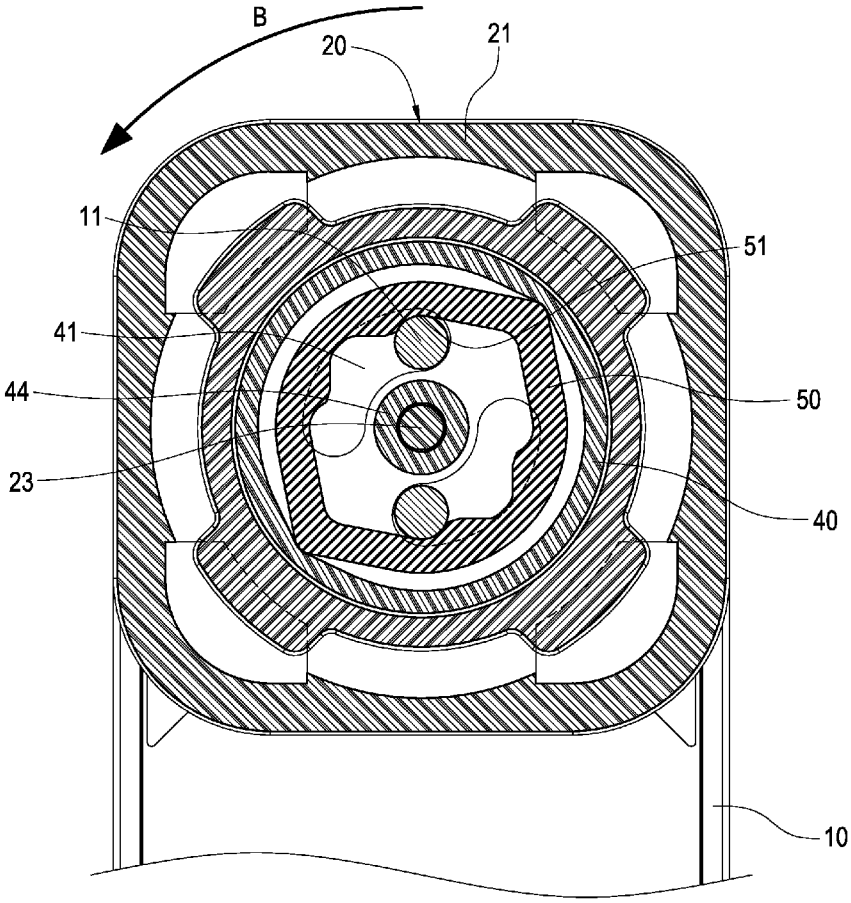
FIG. 6 is a side view of the positioning cover and the braking ring overlaying a side view of the body and the contour of the base, as depicted in FIG. 4, after the plug is rotated counterclockwise in accordance with one or more embodiments.
Figure 7:
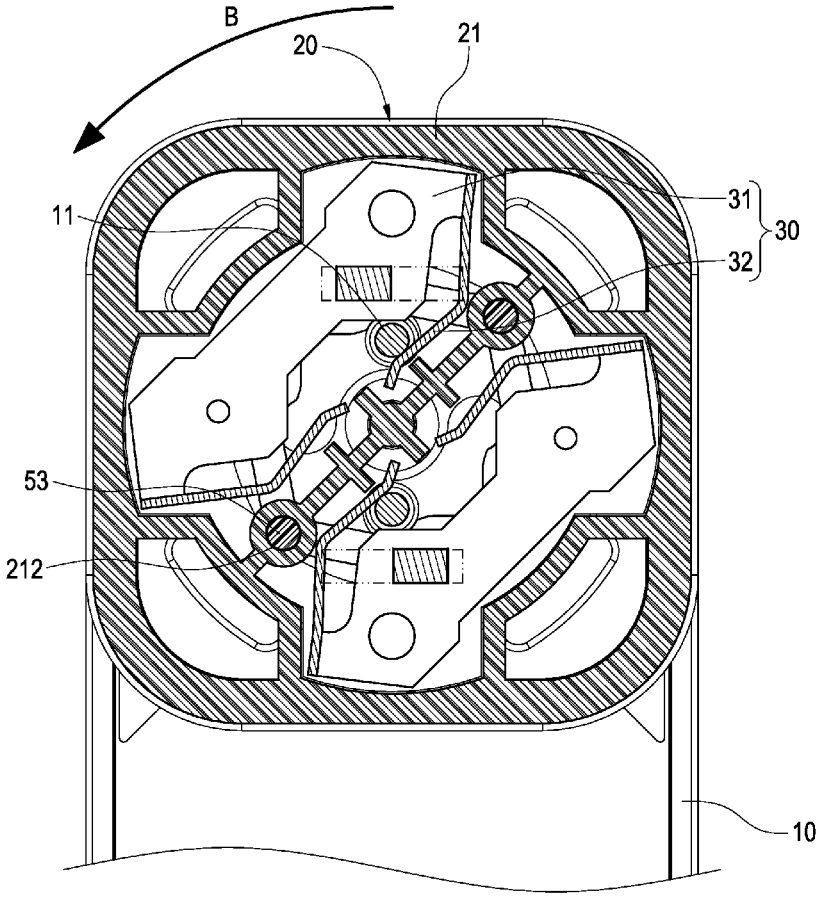
FIG. 7 is a side view of the two conductors overlaying a side view of the body and the contour of the base, as depicted in FIG. 5, after the plug is rotated counterclockwise in accordance one or more embodiments.
Figure 8:
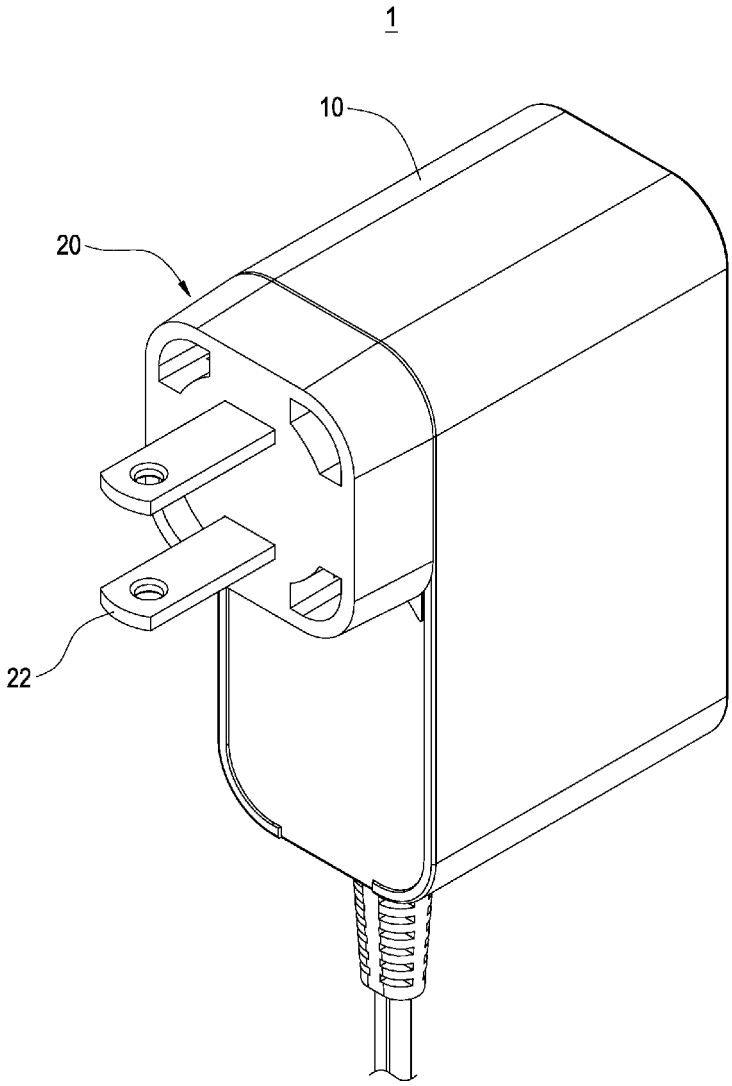
FIG. 8 is a perspective view of the power supply in FIG. 3 after the plug is rotated counterclockwise in accordance with one or more embodiments.

Referring to FIG. 6, a side view of the positioning cover and the braking ring overlaying a side view of the body and the contour of the base, as depicted in FIG. 4, after the plug is rotated counterclockwise. Also referring to FIG. 7, a side view of the two conductors overlaying a side view of the body and the contour of the base, as depicted in FIG. 5, after the plug is rotated counterclockwise. When the plug 20 rotates, the two terminals 11 slide in the two guiding slots 41, respectively. After the plug 20 rotates 45 degrees in a counterclockwise direction B on the body 10, the two terminals 11 move along the guiding slots 41 to one side of the positioning groove 51. As showed in FIG. 8, a perspective view of the power supply in FIG. 3 after the plug is rotated counterclockwise. At this time, the two terminals 11 are in contact with the opposing wings 32 of the two conductors 30, respectively. The plug 20 is fixed on the body 10, and the two pins 22 are arranged in a line with respect to the body 10 along the longitudinal direction of the body 10.

Figure 9:
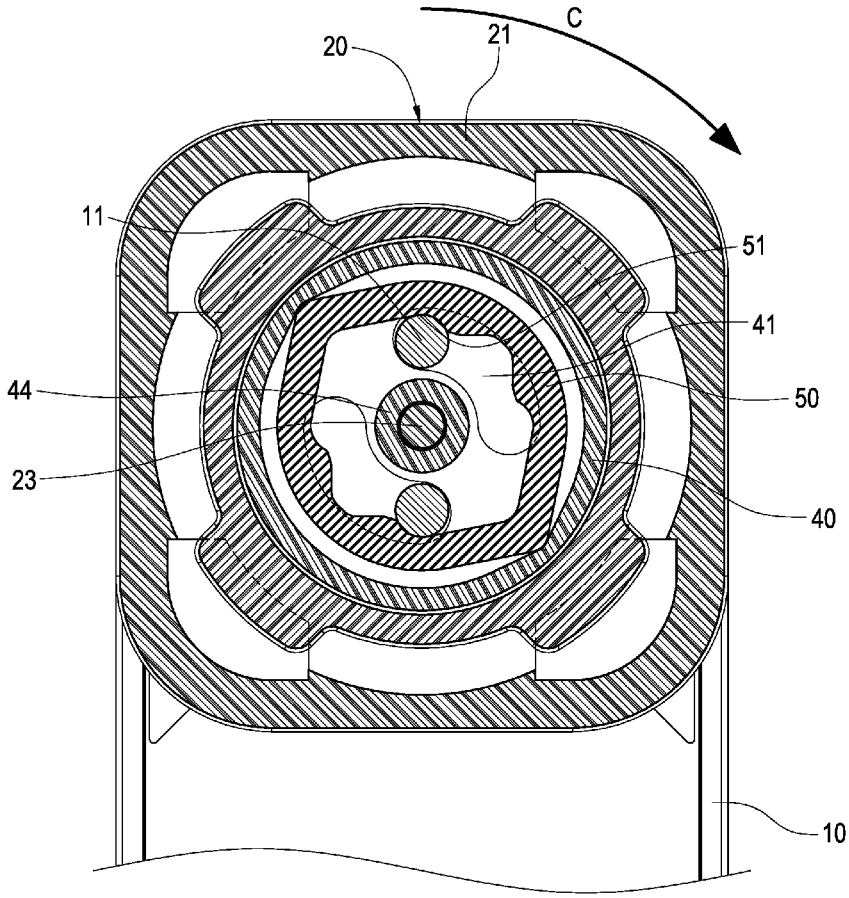
FIG. 9 is a side view of the positioning cover and the braking ring overlaying a side view of the body and the contour of the base, as depicted in FIG. 4, after the plug is rotated clockwise in accordance with one or more embodiments.
Figure 10:
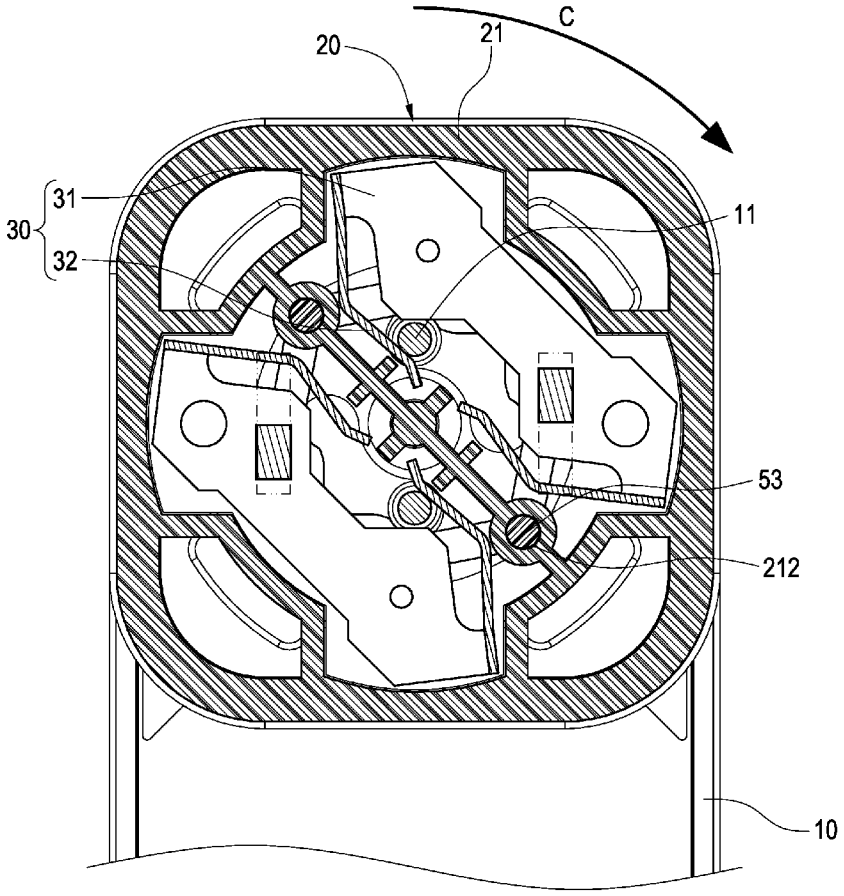
FIG. 10 a side view of the two conductors overlaying a side view of the body and the contour of the base, as depicted in FIG. 5, after the plug is rotated clockwise in accordance with one or more embodiments.
Figure 11:
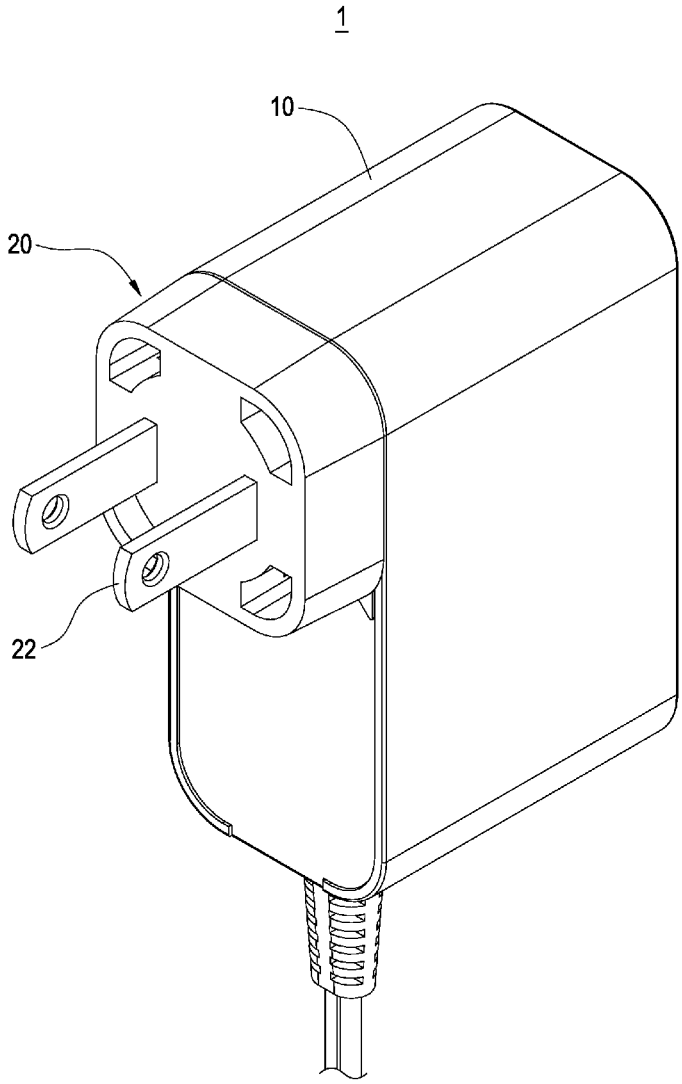
FIG. 11 is a perspective view of the power supply in FIG. 3 after the plug is rotated clockwise in accordance with one or more embodiments.

Referring to FIG. 9, a side view of the positioning cover and the braking ring overlaying a side view of the body and the contour of the base, as depicted in FIG. 4, after the plug is rotated clockwise. Also referring to FIG. 10, a side view of the two conductors overlaying a side view of the body and the contour of the base, as depicted in FIG. 5, after the plug is rotated clockwise. After the plug 20 rotates 45 degrees in a clockwise direction C on the body 10, the two terminals 11 move along the guiding slots 41 to one side of the positioning groove 51. As showed in FIG. 11, a perspective view of the power supply in FIG. 3 after the plug is rotated clockwise. At this time, the two terminals 11 are in contact with other opposing wings 32 of the two conductors 30, respectively, and the plug 20 is fixed to the body 10. The two pins 22 are arranged in a line with respect to the body 10 along the transversal direction of the body 10.

In conclusion, the plug 20 is detachably or removably connected to the body 10, and is able to make multi directional rotation with respect to the body 10. Moreover, the plug 20 can directly rotates to change the plugging direction on the body 10, which is very easy for using.

The embodiments being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A power supply, comprising:

a body having a docking space and two terminals protruding from the docking space; and a plug detachably mounted to the body, comprising:

a base having an accommodating space;

two conductors oppositely arranged in the accommodating space; a positioning cover connected to the body and covering the accommodating space, the positioning cover having two guiding slots corresponding to the two terminals, the two terminals being correspondingly arranged in the two guiding slots respectively; and a braking ring arranged between the two conductors and the positioning cover, an interior edge of the braking ring being corresponding to the two guiding slots and being provided with a plurality of positioning grooves, wherein the plug is configured to rotate in multi-direction with respective to the body, and the two terminals are slidably received in the guiding slots and are positioned in the positioning grooves to be electrically coupled to the two conductors respectively.

2. The power supply according to claim 1, wherein a convex ring is formed in an outer edge of the docking space of the body, a plurality of blocking elements are formed at intervals in the top edge of the convex ring, a plurality of embedding slots are formed correspondingly in the periphery of the accommodating space of the base, and the blocking elements are correspondingly arranged in the embedding slots and slidably mounted in the accommodating space.

3. The power supply according to claim 1, wherein the plug further comprises two pins, and the two pins are arranged on one side of the plug and electrically connect the two conductors.

4. The power supply according to claim 1, wherein each conductor comprises a retaining board and a pair of opposing wings vertically extending on both sides of the retaining board, respectively, and the two pairs of opposing wings are arranged to define a gap therebetween.

5. The power supply according to claim 1, wherein the positioning cover comprises a cover plate and a side plate surrounding the cover plate, and the two guiding slots disposed on the cover plate.

6. The power supply according to claim 5, wherein the cover plate has a tube between the two guiding slots, the base has a positioning shaft corresponding to the accommodating space, and the tube is configured to receive the positioning shaft.

7. The power supply according to claim 5, wherein a first side of the cover plate has a plurality of first connecting holes, a first side of the braking ring has a plurality of first convex pillars corresponding to the plurality of first connecting holes, and the first convex pillars are connected to the first connecting holes.

8. The power supply according to claim 7, wherein the base has a plurality of second connecting holes in the accommodating space, a second side of the braking ring has a plurality of second convex pillars corresponding to the plurality of second connecting holes, and the second convex pillars are connected to the second connecting holes.

9. The power supply according to claim 1, wherein the positioning grooves are provided in the opposite side of the interior of the braking ring, and the positioning grooves are formed in a continuous half arc shape.

10. The power supply according to claim 1, wherein the braking ring is against the interior of the positioning cover, and the two terminals are each arranged between the positioning grooves and the wall of the guiding slot.

11. The power supply according to claim 9, wherein the braking ring is against the interior of the positioning cover, and the two terminals are arranged each between the positioning grooves and the wall of the guiding slot.

* * * * *